United States Patent [19]

Ross et al.

[11] 4,362,334

[45] Dec. 7, 1982

[54] PORTABLE FOLDING ORTHOPEDIC SEAT

[75] Inventors: Robert M. Ross, Redondo Beach; George M. Kristof, Gardena, both of Calif.

[73] Assignee: Accu-Back, Inc., Carson, Calif.

[21] Appl. No.: 196,387

[22] Filed: Oct. 14, 1980

[51] Int. Cl.[3] ..... A47C 7/02

[52] U.S. Cl. ..... 297/230; 297/284; 297/DIG. 6

[58] Field of Search ..... 297/230, 231, 284, 460, 297/DIG. 6

[56] References Cited

U.S. PATENT DOCUMENTS 2,905,230 9/1959 Gabriel ..... 297/284
3,086,817 4/1963 Wilfert ..... 297/284
3,279,849 10/1966 Radke et al. ..... 297/DIG. 6
4,161,337 7/1979 Ross et al. ..... 297/284

*Primary Examiner*—Francis K. Zugel
*Attorney, Agent, or Firm*—Owen, Wickersham & Erickson

[57] ABSTRACT

A portable folding orthopedic seat unit for use on a chair, automobile seat, or the like. A seat member is hinged to a back member. Vertical tracks extend from the bottom to the top of the back member and support a back-support assembly, comprising two separate, generally elliptically-shaped, centrally extending padded back-support members, spaced apart from each other, and a connecting member joining them together. The connecting member also serves to transfer forces from one back-support member to the other. Two strips that adhere to each other on contact are used to hold the assembly at a selected vertical position on the tracks.

21 Claims, 10 Drawing Figures

FIG. 1
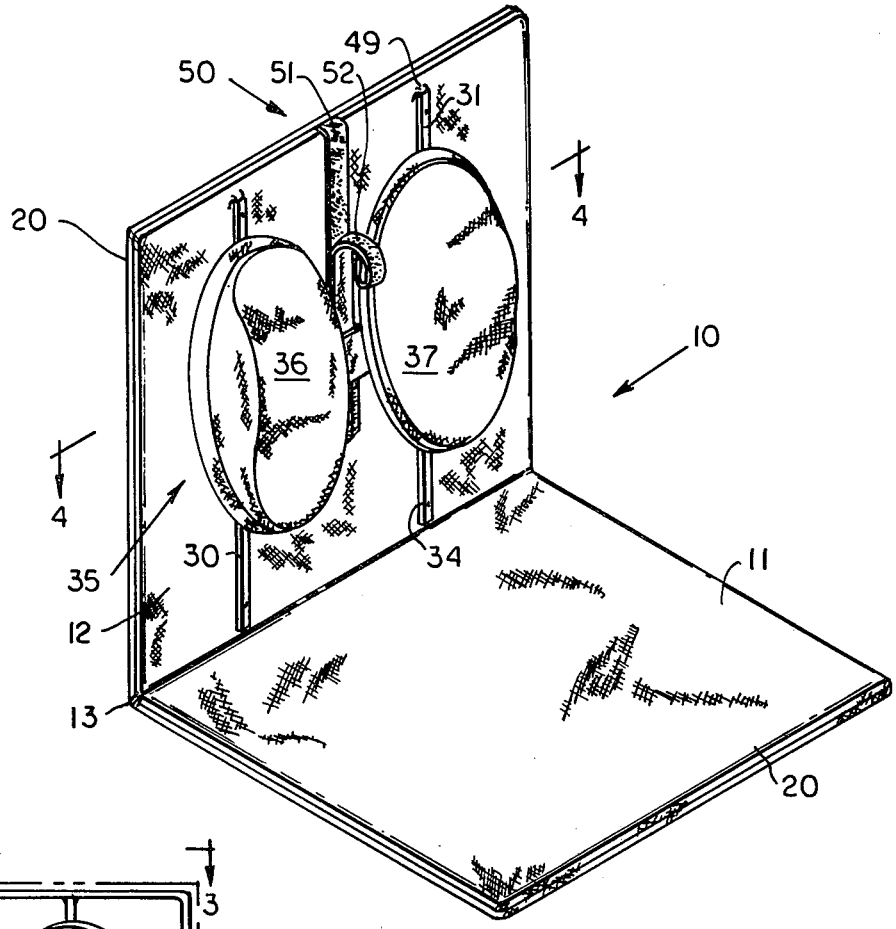
FIG. 2
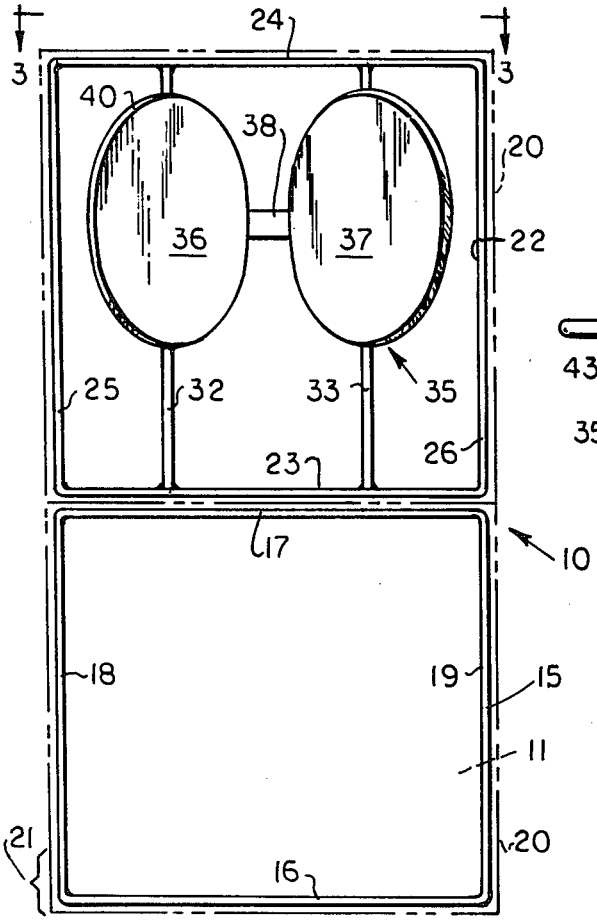
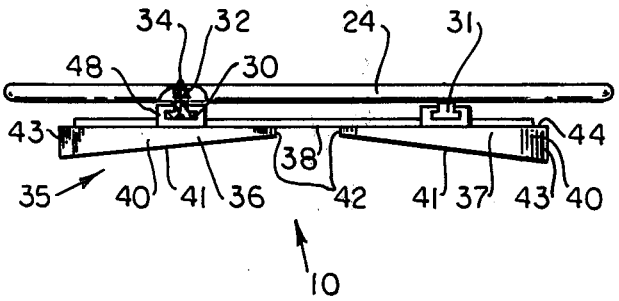
FIG. 3

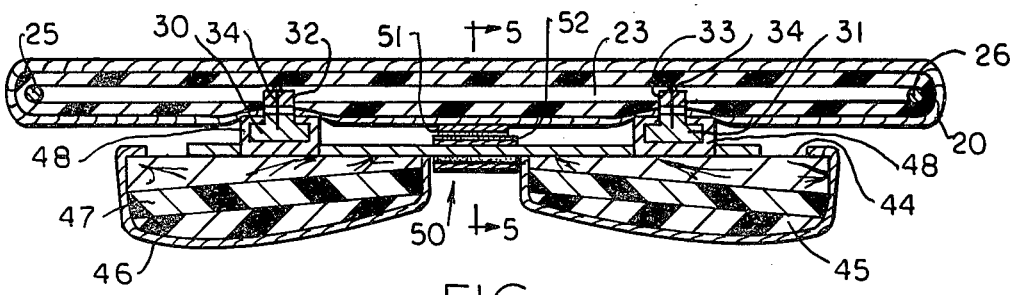
FIG. 4
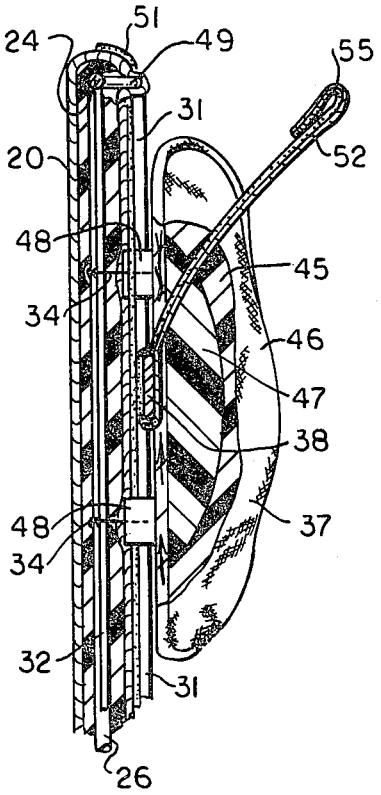
FIG. 5
FIG. 6
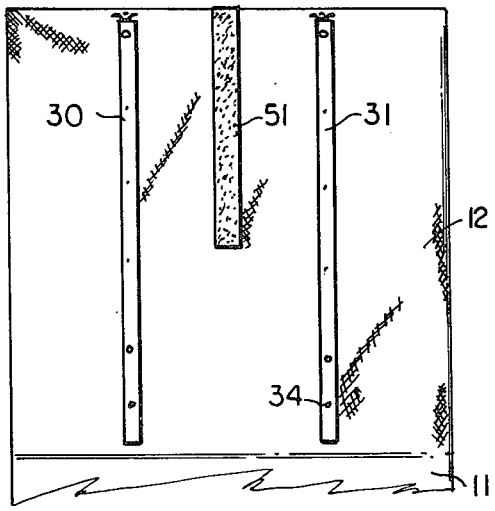
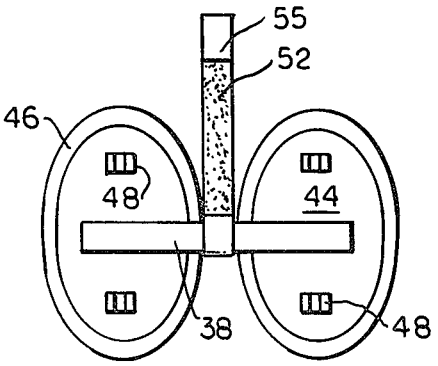
FIG. 7

FIG. 8
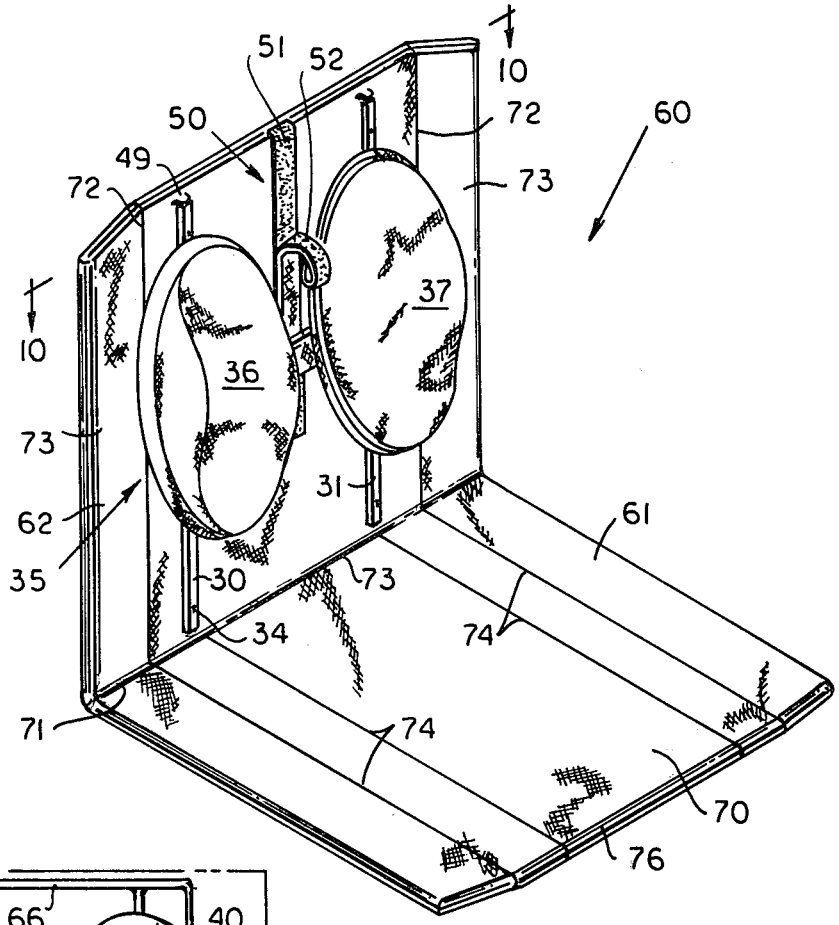
FIG. 9
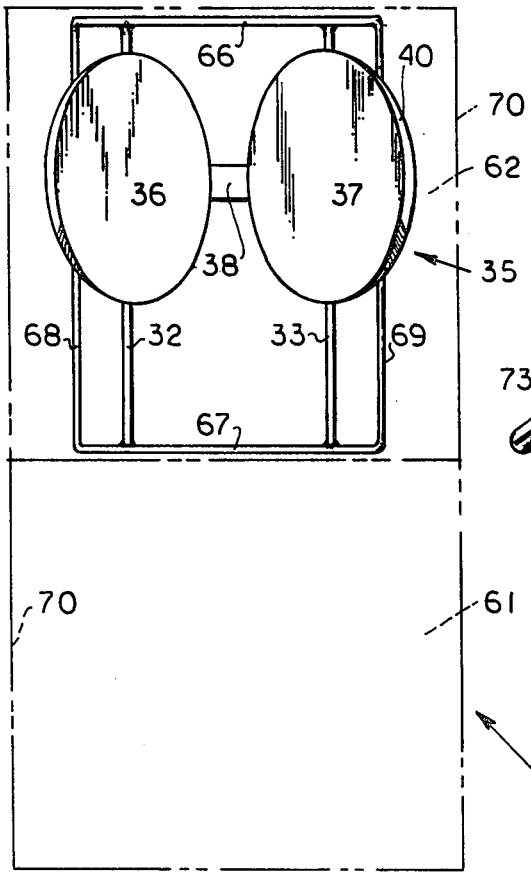
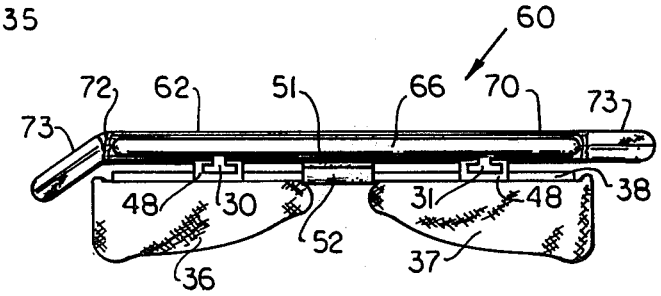
FIG. 10

PORTABLE FOLDING ORTHOPEDIC SEAT

BACKGROUND OF THE INVENTION

This invention relates to an improved portable orthopedic seat unit insert for providing support for the lower back of the sitter and for relieving lower-back discomfort.

A great many people find regular chairs and sofas uncomfortable and ordinary automobile seats unbearable. For example, for a long cross-country flight in a commercial airline, although many people may find the seats sufficiently comfortable, there are also many who find them unduly uncomfortable and view the taking of such a trip as a very difficult experience. Similarly, many people find that their automobile seats lack comfort; most people put up with the discomfort, but those who have a back problem find riding in such seats very difficult, and they often find prolonged driving to be an excruciating experience.

Seat inserts have heretofore generally been provided for the purpose of obtaining ventilation to the rear of or under the sitter, or to provide mere cushioning, but were only rarely directed to the orthopedic problem. Most of them have generally provided merely a flat back portion and a flat seat portion hinged together; they sought no special approach for support of the lower back and therefore usually had no special shaping.

The present invention is an improvement on that of U.S. Pat. No. 4,161,337 (Ross et al.) which discloses and claims a portable folding orthopedic seat unit having a pair of oval back-support pads adjustably mounted with latching members to a single central vertical bar, disposed at an angle to the back of a seat pad. This device had many good qualities and provided the needed back support when used with many chairs and seating units. However, the unit was quite heavy and therefore somewhat difficult for users to carry, especially if they were elderly or infirm. A specific problem was that the means for adjustably securing the back pads to the back member was particularly heavy and somewhat awkward in use. Another problem was that a specific design would be required for bucket seats, and each bucket seat would have required a different, specially shaped seat unit. Otherwise, the seat member of the unit would be suspended between the raised edges of many types of bucket seats which the unit was not specifically designed for.

Ross' U.S. Pat. No. 4,161,337 also showed a seat unit having a pair of back-support pads held together at their backs by a connecting member, which in turn was adjustably attached to a narrow, uncovered back frame. Each pad had mounting members which cooperated with reciprocal openings in the frame, which combined to provide several spaced apart adjustment heights for the pads. The pads, however, were not adjustable to every point over the length of the frame and the process of adjusting them was somewhat difficult.

These and other problems are solved in the present invention.

An important object of the present invention is to provide a lightweight portable orthopedic seat insert which greatly adds to the comfort of the sitter, especially one having back problems.

Another object is to provide a readily portable folding seat insert which can be taken aboard planes, put in automobiles, and generally moved from place to place, being both compact and light in weight, while also convenient to carry.

A further object is to provide an orthopedic seat insert that enables convenient adjustment of support pads to any desired height along its back for each individual and at any time, for quickly providing support where needed.

Still another object of the invention is to devise a light-weight mechanism having a minimum of heavy metal parts for adjustably mounting the back-support pads on a portable seat to a precise position.

Yet another object is to provide an orthopedic seat insert which comfortably fits into all shapes of bucket seats as well as with other types of seats.

Another object is to provide a novel back-support pad construction for increasing the comfort and support of an orthopedic seat.

Still other objects and advantages will appear from the following description.

SUMMARY OF THE INVENTION

The present invention provides a portable folding orthopedic seat unit, for use on a chair, sofa, automobile seat, airplane seat, and the like. A seat member is connected to a back member, preferably comparable in over-all area to the seat member. The back and seat members can be collapsed together to a generally flat position and can be opened to a seating position. A pair of tracks are vertically mounted on the back member, and a back-support assembly is supported adjustably, preferably freely slidably, on the tracks. The adjustable back-support assembly comprises two separate, spaced-apart, padded, generally elliptically-shaped, back-support pads and a rigid horizontal bar joining them together. Preferably, each back-support pad comprises a rigid rear portion slidably attached to the track, a forward, padded, centrally extending, resilient portion supported by the rear portion, and cover means enclosing both the padded portion and the rear portion. Easily releasable locking means cooperate with the back member for securing the assembly at a selected vertical position.

In a presently preferred form of the invention, a semi-rigid back member has an abbreviated rigid quadrilateral frame supporting a resilient cushion affording free air passage therethrough, and an air-permeable cover encloses the frame and the cushion means. The resilient cushion and cover extend beyond either side of the frame, leaving an unsupported side margin. In this form of the invention, the seat member has no rigid frame but comprises a resilient cushion and an air-permeable cover. This form is particularly adapted to use in bucket seats and the like, where only additional back support is required in an otherwise contoured seat.

In another preferred form, adapted for use where full back and seat support are desired, both the semi-rigid back member and a similar seat member have a rigid quadrilateral marginal frame supporting a resilient cushion and cover.

The locking means for holding the back-support pads in place vertically include two strips which adhere together on contact. One such strip is vertically attached to the back member centrally between and in parallel with the two tracks. The second strip material is attached to the horizontal connecting bar between the two back-support pads. A preferred material for the strips is Velcro. The second strip may be long enough for use in carrying the unit.

Also, in one presently preferred form of the invention, each back-support member comprises a rigid rear portion, its front lying in a plane tilted outwardly relative to the back member, and its back lying flush against the back member. A resilient cushion and central wedge are supported on the rigid portion, and a cloth cover encloses the cushion, wedge, and the rear portion.

BRIEF DESCRIPTION OF THE DRAWINGS

FIG. 1 is a view in perspective of a full-support seat unit embodying the principles of the invention, shown opened to a seating position.

FIG. 2 is a top plan view of the normally covered frame members of the seat unit of FIG. 1, shown lying flat, with the cloth cover boundaries shown in dashed line.

FIG. 3 is a top view of the frame of FIG. 2, partially broken away, taken along line 3—3 in FIG. 2, illustrating the frame and pad support construction of the back member.

FIG. 4 is an enlarged view in section taken along the line 4—4 in FIG. 1.

FIG. 5 is an enlarged fragmentary sectional view of the upper back member of a seat unit of the invention, taken along line 5—5 in FIG. 4.

FIG. 6 is a front view of the back portion of FIG. 1, with the adjustable support assembly removed and with the same portion broken away.

FIG. 7 is a rear view of the adjustable support assembly of a seat unit of FIG. 1.

FIG. 8 is a view in perspective of a modified form seat unit embodying the principles of the invention and suitable for use in a bucket seat and other such environments; the unit is shown opened to a seating position.

FIG. 9 is a top plan view of the frame members of the unit of FIG. 8 lying flat, with the cover boundaries shown in dashed line.

FIG. 10 is a top view of the back of the unit of FIG. 8, taken along the line 10—10 in FIG. 8, illustrating the front pad support construction of the back member, shown without the seat member.

DESCRIPTION OF SOME PREFERRED EMBODIMENTS

A Full-Support Embodiment (FIGS. 1-7)

A full-support unit 10, comprises a seat member 11 and a back member 12 connected together at a hinge 13.

Like the seat illustrated in U.S. Pat. No. 4,161,337, the seat member 11 may have a marginal quadrilateral rigid frame 15, composed of a front marginal frame portion 16, a rear frame portion 17, and side frame portions 18 and 19. A series of interwoven, spaced-apart resilient strips or bands (not shown here but shown in U.S. Pat. No. 4,161,337), or a layer of resilient material such as foam rubber may extend across the frame 15. The frame 15 and the strips (when used) are then enclosed, preferably in a loosely woven cloth cover 20 (the outer line of which is illustrated in dashed lines in FIG. 2), which enables relatively free flow of air for ventilation. A forward portion 21 of the side frame members 18 and 19 may, if desired, be bent downwardly to increase comfort at the seat edge. The cover 20 preferably extends around both the seat member 11 and the back member 12, and preferably has a reinforced seam which serves as the hinge 13 between the two members 11 and 12.

The back member 12 may be similar to the seat member 11. As shown in FIG. 2 it may also have a quadrilateral rigid frame 22 with a bottom frame portion 23, a top frame portion 24, and side frame portions 25 and 26. Well-spaced resilient bands (not shown here but shown in U.S. Pat. No. 4,161,337) or a layer of resilient material such as foam rubber may extend from side to side on the back member 12. The back member 12 is also enclosed in the loosely-woven cover 20.

The seat unit 10 is constructed so that the seat member 11 may rest upon a regular automobile seat, or a flat chair, sofa, or airplane seat, and the back member 12 rests against the corresponding back of the seat.

A pair of parallel tracks 30 and 31 are attached to the back member 12, extending vertically substantially from its top to its bottom. The tracks 30 and 31 are disposed equidistant from the vertical centerline of the back member 12, in one embodiment at approximately one half the distance to the right and left edges of the seat back member 12. The tracks 30 and 31 are attached to a pair of corresponding parallel internal support members or bars 32 and 33 which are disposed inside the back member 12. The tracks 30 and 31 are attached by suitable securing means 34, such as rivets, staples, screws, or nuts and bolts. The bars 32 and 33 are attached, as by a weld, to the top and bottom back frame portions 23 and 24. The tracks 30 and 31 may, for example, be T-shaped plastic strips, as illustrated in FIG. 3. The cover 20 is disposed between the tracks 30 and 31 and their corresponding bars 32 and 33.

A separate, adjustable back-support assembly 35 and a unique securing mechanism cooperate with the back member 12 to enable a great range of adjustability. The assembly 35 comprises two spaced-apart back support members 36 and 37 preferably generally vertically oriented and preferably elliptically shaped, connected by a central, rigid horizontal connecting member or bar 38.

The two back-support pads 36 and 37 may be identical, with symmetric orientation. As illustrated, each pad 36 and 37 has a hard back mounting surface 40 made of wood, metal, chipboard block or the like. The back mounting surface 40 has a slanting face portion 41 so that the block 40 is thinnest at its inner edge 42 and thickest at its outer edge 43. As best illustrated in FIGS. 4 and 5, the back surface 44 of the block is preferably held parallel to the back member 12. The forward surface 41 extends at an angle to the plane of the back member 12, which is preferably between 10 and 20 degrees. This provides extra support for the user's back and also helps to keep his back centered in the unit 10.

A resilient foam material 45, such as Temper Foam, originally developed by NASA, provides a cushion over the pad support blocks 40. This cushion 45 is responsive to body heat and pressure which cause it to "flow" and to conform to the shape of the user's back, thereby providing ideal support to the lumbar region. A cover 46, preferably cloth like the cover 20, encloses the cusion 45 and the forward and side portions of pad support blocks 40. For aesthetic purposes, the horizontal connecting member 38 may also be covered with the same cover material. In a preferred embodiment, an additional central wedge 47 of foam (see FIGS. 4 and 5) is disposed between the forward surface 41 of the pad support blocks 40 and the foam packing material 45, extending from the inner edge 42 to the outer edge 43, just above the central portion of the pad 36.

The back-support pads 36 and 37 are slidably attached to the tracks 30 and 31 by slidable attaching means 48 which may be C-shaped brackets, as illustrated in FIGS. 3 and 5. The assembly 35 slides vertically. The slidable attaching means 48 are connected to the back surface 44 of the pad support block 40. Preferably, as shown in FIG. 5 there are two slidable attaching means 48 on each pad 36 and 37, one near the top and the other near the bottom. An extension 49 (FIG. 5) is disposed substantially near the upper boundary of the back 32 to stop the upward movement of the back support assembly 35, keeping the pads 36 and 37 on their tracks 30. The extension means 49 may be a screw head, a welded spot, or the like.

As shown most clearly in FIGS. 6 and 7, adjustable securing means 50 hold the back support assembly 35 at any desired height. The adjustable securing means 50 comprise two strips 51 and 52 which adhere to each other upon contact. A first strip 51 is attached to the back member 12 along the centerline (FIG. 2) extending from the top of the unit 10 toward its bottom. In a preferred embodiment, the first strip 51 extends approximately halfway down the back member 12. A second strip 52, also preferably about half the height of the back member 12, is attached at the center of the horizontal connecting member 37 and extends upwardly for contact with the first strip 51. The top of the second strip 52 may be extended and looped around to form a carrying means 55. In a preferred embodiment, the first and second strips 51 and 52 are made of Velcro. Alternatively, two magnetically attractive strips may be used. Another possibility is that the second strip 52 could have a series of holes disposed along its length and the first strip 51 could have a series of projections which would be received by the holes. A sufficient number of holes and projections would be provided to give a wide range of adjustability.

The Bucket Seat Embodiment (FIGS. 8–10)

A second seat unit 60 illustrates a preferred embodiment of the invention which is adapted for use in bucket seats and other seats having a pronounced contour. The unit 60 comprises a seat member 61 and a back member 62 connected together by a suitable hinging means 63. This hinging means 63 (and also the hinging means 13) may comprise a pair of door-type hinges, a single piano hinge, or a seam in the cover material between the seat member 11 and the back member 12, as will be further described later.

The chief difference between the full support unit 10 and the bucket seat unit 60 lies in the frame construction. As illustrated in FIG. 8 the back member 62 of the unit 60 has an abbreviated quadrilateral rigid frame member 65 having a top frame portion 66, a bottom frame portion 67, and side frame portions 68 and 69. The top and bottom frame portions 66 and 67 are closer together than the portions 25 and 26 of the unit 10, they extend only partially across the width of the back member 62, approximately 20% less in the bucket seat unit 60 than in the full support unit 10. The lengths of the side portions 68 and 69 remain the same in both units. The bucket seat unit 60 has no rigid frame in the seat member 61, making the seat member 60 very pliable.

Cover material 70 surrounds both the seat member 61 and the back member 62, preferably having a reinforced seam 71 to provide the hinge 63. In the back member 12, just outside the side frame members 68 and 69, there may be additional seams 72 defining unsupported marginal edge portions 73, as shown in FIG. 8. The cover 70 also may have a plurality of parallel seams 74 extending from the back 75 to the front 76 of the seat member 61. These seams 74 provide support to the seat member 61 in the absence of a rigid frame.

Otherwise, the bucket seat unit 60 and the full support unit 10 are identical.

When properly in place, the pads 36 and 37 provide distributed support on each side of the sacrolumbar region of the spine of the user. The pads 36 and 37 being separate, are sufficiently raised to relieve the spine of all contact with the back member 12 or 62 and support the body on each side of the spine, distributing the supportive forces over the specific areas needing them. The cushioning portions 45 automatically accommodate to the shape of the user's back and provide proper and gentle distributed support to the lower back area. In combination with the seat bottom 11 and 61 they are adjustable to fit the dimensions of any user's back, and help the user to maintain optimum posture and thereby minimize strain.

Rearward pressure on and movement inward of one member 36 is transmitted through the connecting member 38 to generate a compensating forward pressure and outward movement of the other member 37, and vice versa. Thus, the assembly 35 adjusts itself to lateral and twisting movements of the user and, as a result, precise horizontal positioning is not critical to proper functioning of the seat unit 10 or 60.

The seat units 10 and 60 of the invention are lighter in weight than earlier units were, making it easier to carry them. The units are more precisely adjustable than were the units of U.S. Pat. No. 4,161,337, since the securing means 50 is not limited to incremental levels along the back member 12 or 62. Also, the use of Velcro in combination with the free sliding tracks 30 make the units 10 and 60 of the present invention far more easy to adjust than before. Finally, the bucket seat unit 60 allows users to enjoy much needed back support in cars having bucket seat without having to design a unit which is tailor fit to each particular type of bucket seat used in automobiles.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. In a portable folding orthopedic seat unit having:

a seat member hinged to a back member with an internal rigid support frame extending from the bottom to the top of said back member, and a cloth cover enclosing said seat member and said back member, a pair of separate, padded, generally elliptically-shaped, back-support members, spaced apart from each other and joined by a horizontally rigid connecting member, each said back-support member comprising a rigid rear portion attached to said connecting member, a forward resilient portion supported on said rear portion, and cloth cover means enclosing said resilient portion and said rear portion, the combination therewith of:

two vertical parallel internal track support members attached inside said back member to said rigid frame, two parallel separate guide tracks attached through said back member to said internal track support members, extending substantially from the bottom to the top of said back member, slidable clip means reciprocal with said guide tracks attached to the back of said rigid rear portion of said pair of back support members, for slidably mounting said back-support members on said guide tracks, said pair of back-support members being slidably disposed on said parallel guide tracks, a first strip of material attached to the middle of said back member parallel with said guide tracks, and, a second strip of material which adheres to said first strip of material upon contact therewith, said second strip being attached to said horizontally rigid connecting member and disposed vertically upwardly between said back-support members, whereby said back-support members may be adjusted to solely support the lower back of a person sitting in said seat unit by sliding said pair of back-support members on their guide tracks to a desired position and securing said second strip of material to said first strip of material, thereby holding said back-support members at the desired position.

2. The portable folding orthopedic seat unit of claim 1 wherein said first and second strips of material are corresponding strips of Velcro.

3. The portable folding orthopedic seat unit of claim 1 wherein each said back-support member has a central wedge of resilient material which is thicker at the middle than at the top and bottom, thereby conforming to the curvature of the back of a person sitting in said seat unit.

4. The portable folding orthopedic seat unit of claim 1 or 3 wherein said resilient material is of the type that is redistributed by body heat and pressure to conform to the shape of any particular user's back.

5. The portable folding orthopedic seat unit of claim 1 wherein said internal rigid support frame comprises:

a pair of parallel vertical frame portions and a pair of parallel horizontal frame portions, said vertical frame portions extending substantially from the bottom to the top of said back member, the ends of said vertical frame portions connected to the ends of said horizontal frame portions, the ends of said parallel internal track support members being connected to said horizontal frame portions, equidistant from the vertical centerline of said back member and between said vertical frame portions, said horizontal frame portions extending partially across said back member, leaving side margins of unsupported cloth cover between said vertical frame portions and the side edges of said back member, for fitted use of said seat unit with a variety of types of bucket seats and the like.

6. The portable folding orthopedic seat unit of claim 5 wherein the length of said horizontal frame portion is approximately 80% of the width of said back member.

7. The portable folding orthopedic seat unit of claim 5 wherein said seat member comprises a layer of resilient padding enclosed by said cloth cover.

8. The portable folding orthopedic seat unit of claim 7 wherein said seat member further comprises a plurality of reinforcing seams extending from said hinge to the front edge of said seat member.

9. The portable folding orthopedic seat unit of claim 1 wherein said internal rigid support frame comprises:

a pair of vertical frame portions extending substantially from the bottom to the top of said back member, and a pair of horizontal frame portions extending substantially across said back member, the ends of said vertical frame portions being connected to the ends of said horizontal frame portions, the ends of said parallel internal track support members being connected to said horizontal frame portions, equidistant from the vertical centerline of said back member and between said vertical frame portions, and a second internal rigid support frame in said seat member extending to the peripheral edge of said seat member from its back to its front and from side to side, and a layer of resilient padding inside said seat member, said seat member internal rigid frame and padding being enclosed by said cloth cover.

10. The portable folding orthopedic seat unit of claim 7 or 9 wherein:

said cloth cover encloses said back member and said seat member, and said hinge comprises a reinforced seam in said cloth cover between said back member and said seat member.

11. The portable folding orthopedic seat unit of claim 1 further comprising a grasp portion on said second strip of material for use as a carrying handle when transporting said seat unit.

12. The improved portable folding orthopedic seat unit of claim 1 wherein:

said back-support members' rigid rear portions are thinner at the sides nearest said strips of material than at the sides furthest from said strips of material, thereby causing said forward resilient portions to extend outwardly toward the edges of said unit at an angle away from the plane of said back member.

13. A portable folding orthopedic seat unit for use on a chair, an automobile bucket seat, and the like, including in combination:

a seat member, a back member hinged to said seat member so that they can be collapsed together to a generally flat position and opened to a seating position, a cloth cover surrounding said seat member and said back member, an abbreviated internal quadrilateral rigid frame in said back member having a pair of vertical portions extending substantially from the bottom to the top of the back member and a pair of horizontal portions extending partially from side to side of the back member, thereby leaving an unsupported side margin of said cloth cover on said back member an adjustable back-support assembly, comprising:

two vertical tracks disposed on said back member substantially equidistant from the centerline of said back member, extending substantially from the bottom to the top of said back member, two separate, padded, generally elliptically-shaped, back-support pads having a hard back mounting surface and a resilient front padded surface, both said surfaces being surrounded by a cloth cover, one said pad being slidably mounted on each said track, a rigid horizontal bar extending between and connecting the backs of said back-support pads for their simultaneous adjustment, a first strip of material attached to said back member disposed vertically between said tracks, and a second strip of material connected to said horizontal bar between said back-support pads, said first and second strips of material having faces which adhere to each other upon physical contact between them whereby said back-support assembly may be slidably adjusted to a position on said tracks to comfortably solely support the lower back of a person sitting in said seat unit and may be secured in that position by placing said first strip of material in adhering contact with said second strip of material.

14. The portable folding orthopedic seat of claim 13 wherein said back support-pads' resilient front padded surface further comprises a central horizontal wedge of resilient material.

15. The portable folding orthopedic seat of claim 13 wherein said first and second strips of material are VELCRO.

16. The portable folding orthopedic seat of claim 13 wherein:

said back member's cloth cover has a pair of vertical seams adjacent to said vertical frame members, to define said unsupported side margin and to hold said abbreviated frame at the center of said back member, said seat member has a plurality of seams extending from back to front for providing additional support to said seat member, and said hinge between said member and said seat member is a reinforced seam across said cloth cover between said back member and said seat member.

17. The portable folding orthopedic seat unit of claim 13 further comprising:

a pair of internal track support members disposed vertically inside said back member, said internal track support members being attached at their top and bottom to said horizontal frame portions, and a plurality of attaching means for securing said tracks through said cloth cover to said internal track support members.

18. A portable folding orthopedic seat unit for use on a chair, automobile seat, and the like, including in combination:

a seat member, a back member hinged to said seat member so that they can be collapsed together to a generally flat position and opened to a seating position, a first internal quadrilateral marginal rigid frame in said back member, a second internal quadrilateral marginal rigid frame in said seat member, a cloth cover surrounding said seat member and said back member, and an adjustable back-support assembly, comprising:

two vertical tracks disposed substantially equidistant from the centerline of said back member, extending substantially from the bottom to the top of said back member, two separate, padded, generally elliptically-shaped, back-support pads having a hard back mounting surface and a resilient front padded surface, both said surfaces surrounded by a cloth cover, one said pad slidably mounted on each said track, and a rigid horizontal bar extending between and connecting the backs of said back-support pads for their simultaneous adjustment, a first strip of material attached to said back member disposed vertically between said tracks, and a second strip of material connected to said horizontal bar between said back-support pads, said first and second strips of material having faces which adhere to each other upon physical contact between them, whereby said back-support assembly may be slidably adjusted to a position on said tracks to comfortably solely support the lower back of a person sitting in said seat unit and may be secured in that position by placing said first strip of material in adhering contact with said second strip of material.

19. The portable folding orthopedic seat of claim 18 wherein said back-support pads' resilient front padded surface further comprises a central horizontal wedge of resilient material.

20. The portable folding orthopedic seat of claim 18 wherein said first and second strips of material are VELCRO.

21. The portable folding orthopedic seat unit of claim 18 further comprising:

a pair of internal track support members disposed vertically inside said back member, said internal track support members attached at their top and bottom to said first internal quadrilateral marginal rigid frame at its top and its bottom, and a plurality of attaching means for securing said tracks through said cloth cover to said internal track support members.

* * * * *